US010087739B2

(12) United States Patent
Livescu et al.

(10) Patent No.: US 10,087,739 B2
(45) Date of Patent: Oct. 2, 2018

(54) COILED TUBING-BASED MILLING ASSEMBLY

(71) Applicant: Baker Hughes Incorporated, Houston, TX (US)

(72) Inventors: Silviu Livescu, Calgary (CA); Thomas J. Watkins, Calgary (CA); Jeyhun Najafov, Calgary (CA)

(73) Assignee: BAKER HUGHES, A GE COMPANY, LLC

( * ) Notice: Subject to any disclaimer, the term of this patent is extended or adjusted under 35 U.S.C. 154(b) by 312 days.

(21) Appl. No.: 14/979,672

(22) Filed: Dec. 28, 2015

(65) Prior Publication Data

US 2017/0183930 A1 Jun. 29, 2017

(51) Int. Cl.

| | |
|---|---|
| ***E21B 47/00*** | (2012.01) |
| ***E21B 17/20*** | (2006.01) |
| ***E21B 33/134*** | (2006.01) |
| ***E21B 28/00*** | (2006.01) |
| ***E21B 29/00*** | (2006.01) |

(52) U.S. Cl.

CPC ..... *E21B 47/0006* (2013.01); *E21B 17/206* (2013.01); *E21B 28/00* (2013.01); *E21B 29/00* (2013.01); *E21B 33/134* (2013.01)

(58) Field of Classification Search

CPC ..... E21B 47/0006; E21B 28/00; E21B 29/00; E21B 33/134; E21B 47/065; E21B 47/0002; E21B 47/12; E21B 17/206; E21B 34/14; E21B 2034/007; E21B 17/20; E21B 17/003; E21B 34/066; E21B 47/00; E21B 49/00

See application file for complete search history.

(56) References Cited

U.S. PATENT DOCUMENTS

| | | | | |
|---|---|---|---|---|
| 6,112,809 | A * | 9/2000 | Angle | |
| 2007/0205022 | A1* | 9/2007 | Treviranus | |
| 2011/0198076 | A1* | 8/2011 | Villreal | |
| 2014/0174726 | A1* | 6/2014 | Harrigan | |
| 2016/0298442 | A1* | 10/2016 | Orban | E21B 23/02 |

* cited by examiner

*Primary Examiner* — Wei Wang

(74) *Attorney, Agent, or Firm* — Shawn Hunter

(57) ABSTRACT

A milling assembly for use in milling away an object in a wellbore. A milling bottom hole assembly is run in on a Telecoil® running string and includes a rechargeable power section which is recharged via tube-wire in the running string. The milling bottom hole assembly also includes a sensor section which measures tension, compression and torque experienced by the running string during milling.

19 Claims, 3 Drawing Sheets

COILED TUBING-BASED MILLING ASSEMBLY

BACKGROUND OF THE INVENTION

1. Field of the Invention

The invention relates generally to systems and methods for operation of a milling bottom hole assembly which is incorporated into a coiled tubing running string.

2. Description of the Related Art

A significant number of wells in shale formations require hydraulic fracturing stimulations for economical production. The vast majority of these stimulations are performed by simultaneously fracturing several clusters of perforations followed by a mechanical isolation with composite bridge plugs. The number of plugs is directly dependent on the stimulated well length. Thus, between 20 and 100 plugs are generally used for each well.

After the bridge plugs have been set, they will later need to be removed. Plugs near the entrance to the wellbore can typically be removed with a positive displacement motor and mill run on jointed pipe. Removal of plugs further away from the entrance to the wellbore, either in vertical wells or in long laterals, becomes more challenging as the efficiency of the end loads transmitted from surface to the mill are reduced. This efficiency reduction is primarily due to helical buckling in the coiled tubing near the mill. According to studies available in public literature, the buckled section of coiled tubing might be as long as 20% of the total length of the coiled tubing running string. Because of this helical buckling, quite often the deepest plugs cannot be reached with standard coiled tubing arrangements. Even if the deepest plugs can be reached, helical buckling can render the mill inefficient or unable to mill properly and remove the plug.

A related problem for these types of milling operations is power management. Downhole power is needed to operate bottom hole assembly (BHA) sensors and tools. However, there are operational difficulties. Large downhole batteries are impractical due to their size. Supplying operating power from the surface is also problematic. A conductive cable that is able to transmit a significant amount of power to a downhole tool has a larger diameter. Flow area within a coiled tubing running string would be restricted by a large cable within the coiled tubing flowbore. Additionally, the increase in weight associated with the larger conductive wire is problematic.

SUMMARY OF THE INVENTION

The present invention relates to systems and methods for milling within a wellbore. An exemplary milling arrangement is described which is effective for removing bridge plugs from a wellbore, particularly plugs which are located a significant distance from the wellbore entrance. A milling arrangement is described with a bottom hole assembly that includes a rotary milling bit that is rotationally driven by a milling motor. In primary embodiments, the milling motor is hydraulically driven by fluid flowed from surface. In accordance with alternative embodiments, the milling motor is powered by a power section which contains one or more rechargeable downhole batteries, such as rechargeable lithium batteries. The rechargeable batteries are operably associated with a recharging cradle and a conductive charging wire through which recharging power is supplied from surface. In accordance with particularly preferred embodiments, the conductive charging wire is the tube-wire portion of a Telecoil® running string for the bottom hole assembly.

In accordance with particular embodiments, a vibratory tool operably associated with the milling motor and mill bit improves the effectiveness and rate of penetration of the milling bit. Operating power for the vibratory tool is preferably provided by the power section.

Also in accordance with described embodiments, the bottom hole assembly includes a sensor sub. The sensor sub includes one or more sensors to detect at least one operational parameter associated with the milling operation. In accordance with particular embodiments, the sensor sub measures the tension, compression and torque upon the coiled tubing during run into hole, pulling out of hole and milling. Data reflecting these measurements is transmitted to surface via a data cable in the tube-wire.

According to an exemplary method of operation, a milling assembly is run into the wellbore until the bottom hole assembly is proximate a plug to be removed from the wellbore. The milling motor and vibratory tool are then operated to mill away the plug. Operating power is provided to the vibratory tool and sensor sub by the power section. Milling is enhanced by operation of the vibratory tool which also helps to prevent frictional lockup and helical buckling of the coiled tubing. It is envisioned that the power section can provide at least 4-5 hours of operation before a recharging period is needed. In optimal conditions, the batteries of the power section can provide from about 20 to about 30 hours of operating power.

Also during operation, the sensor sub preferably detects tension, compression and torque experienced by the coiled tubing during run-in and during milling and provides real time information to operators at surface. This information allows operators to adjust weight on the tool and/or milling speed in order to control or reduce helical buckling.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1:
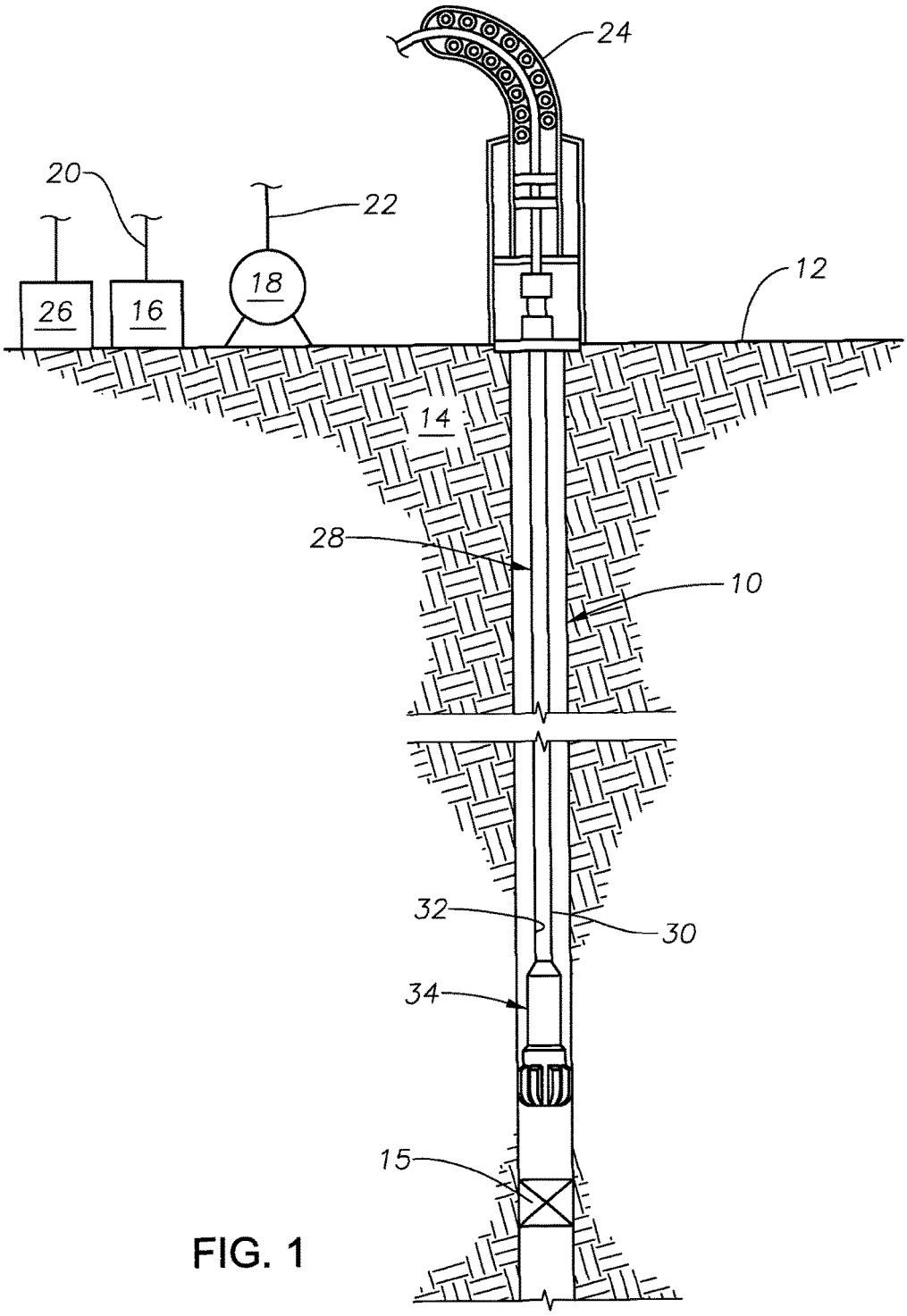
FIG. 1 is a side, cross-sectional view of an exemplary wellbore having a coiled tubing-based milling arrangement run in from surface.

FIG. 1 illustrates an exemplary wellbore 10 which has been drilled from the surface 12 through the earth 14. Although the depicted wellbore 10 is shown as being vertically oriented within the earth 14, it should be understood that the wellbore, or portions thereof, may be inclined or horizontal. The probability of helical buckling is greater in highly deviated or horizontal wellbores. A bridge plug 15 is shown set within the wellbore 10. An electrical power source 16, such as a generator, is located at surface 12 as well as a mud pump 18. The power source 16 and mud pump 18 have outputs 20, 22, respectively, that are operably interconnected with components of the coiled tubing-based milling arrangement, as will be described in further detail. A coiled tubing injector 24 is located at surface 12 and is used to inject coiled tubing into the wellbore 10. A controller 26 is also located at surface 12. The controller 26 is preferably a programmable device, such as a computer, which is capable of receiving data from a downhole sensor arrangement for display to a user and/or for storage. In addition, the controller 26 should be suitably programmed to control particular aspects of a coiled tubing milling operation, such as weight applied to the milling string and speed of the milling motor.

A coiled tubing-based milling arrangement, generally indicated at 28, is shown being injected into the wellbore 10. The coiled tubing-based milling arrangement 28 includes a coiled tubing running string 30 which defines a central bore 32 along its length.

Figure 2:
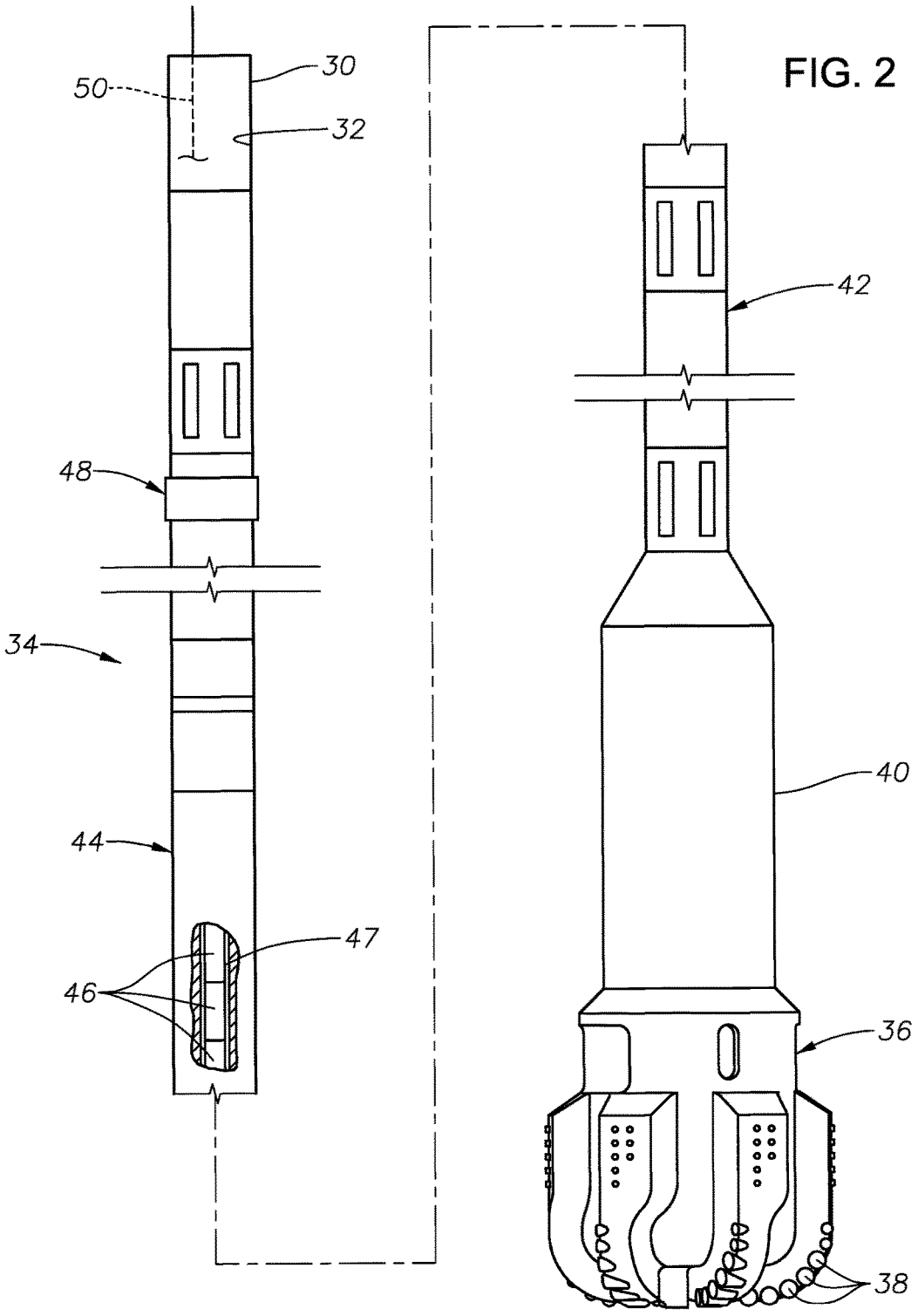
FIG. 2 is a side, cross-sectional view of the coiled tubing-based milling arrangement which incorporates features in accordance with the present invention.

A milling bottom hole assembly 34 is located at the distal end of the coiled tubing string 30. Features of the bottom hole assembly 34 are better appreciated with further reference to FIG. 2. The bottom hole assembly 34 includes a rotary milling bit 36 having cutters 38 thereupon. The milling bit 36 is rotationally driven by milling motor 40 to mill or cut away an object within the wellbore 10 such as plug 15. In some embodiments, the milling motor 40 is hydraulically driven by fluid flowed down through the central bore 32 of the coiled tubing string 30 under impetus of mud pump 18. In other embodiments, the milling motor 40 is an electrically actuated motor and, during operation, is powered by the power section 44.

The milling bottom hole assembly 34 also includes a vibratory tool 42. The vibratory tool 42 is operably connected with the milling motor 40 and functions to impart axial vibrations to the milling motor 40 and bit 36 during a milling operation in order to increase the effectiveness and rate of penetration for the bit 36. A suitable device for use as the vibratory tool 42 is an EasyReach™ fluid hammer tool, which is available commercially from Baker Hughes Incorporated of Houston, Tex. Fluid hammer tools of this type have heretofore been used for decreasing the coiled tubing friction force in extended reach wells. The vibratory tool 42 is typically hydraulically actuated by fluid flow through the coiled tubing running string 30. It requires a minimum pumping pressure to operate efficiently. In alternative embodiments, the vibratory tool 42 is electrically powered. In these embodiments, the vibratory tool 42 is supplied operating power by the power section 44.

The milling bottom hole assembly 34 also includes a power section 44 which supplies operating power to the sensor sub 48. In embodiments where an electrically-driven milling motor is used, the power section 44 would provide operating power to the milling motor 40. In embodiments where an electrically-driven vibratory tool is used, the power section 44 would provide operating power to the vibratory tool 42. Preferably, the power section 44 contains rechargeable batteries 46. The power section 44 is continuously supplied a small amount of power from surface via tube-wire 50 in the coiled tubing string 30, which will recharge the batteries 46. In accordance with currently preferred embodiments, the batteries 46 are rechargeable lithium batteries. However, other rechargeable batteries, including molten salt batteries, might also be used. The batteries 46 are seated within a recharging cradle 47, of a type known in the art, which can impart charge to the batteries 46 as well as hold the batteries 46 in place. In preferred embodiments, the recharging cradle 47 is operably associated with tube-wire 50 so that the controller 26 at surface 12 may be used to turn the power section 44 on and off so that battery power can be conserved when not needed. Preferably also, the cradle 47 will transmit a signal to the controller 26 indicative of the charge level of the batteries 46 so that a user will know when the level of the batteries 46 is too low for proper operation.

In accordance with preferred embodiments, a sensor sub 48 is also included in the milling bottom hole assembly 34. The sensor sub 48 includes one or more sensors to detect at least one operational parameter associated with the wellbore 10 and/or a milling operation. Exemplary operational parameters include wellbore temperature and pressure as well as measurements relating to compression, tension and torque for the milling bit 36. In accordance with preferred embodiments, the sensor sub 48 is a Telecoil® TCT (tension/compression/torque) measurement tool which is available commercially from Baker Hughes Incorporated of Houston, Tex. A Telecoil® TCT measurement tool is capable of measuring tension, compression and torque force that are experienced by the coiled tubing running string 30 during run-in as well as during operation of the milling motor 40. The inventors have determined that monitoring of these parameters can indicate to a user at surface when helical buckling of a coiled tubing string is occurring or about to occur as well as the extent of buckling. Operating power is provided to the sensor sub 48 by the power section 44.

Figure 3:
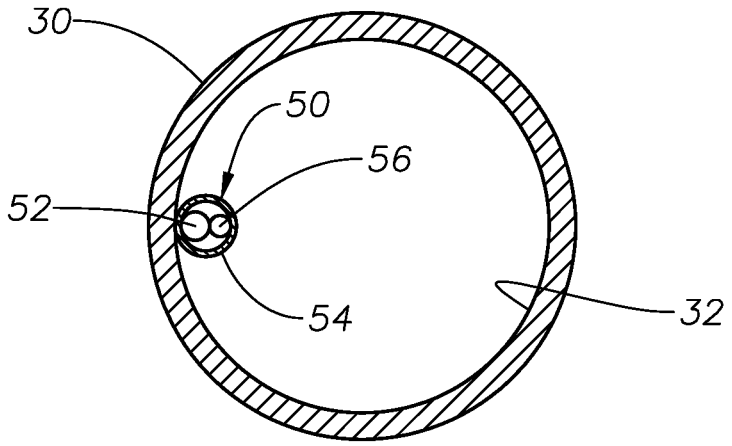
FIG. 3 is an axial cross-section of an exemplary Telecoil style coiled tubing running string used with the milling arrangement shown in FIGS. 1-2.

Telecoil® is a term which refers to the use of tube-wire within coiled tubing. Tube-wire can be disposed inside coiled tubing to provide electrical power and a signal path from the surface to various downhole tools attached to the end of the coiled tubing. Tube-wire is a tube that contains insulated wire that is used to provide electrical power and/or data to the bottom hole assembly or to transmit data from the bottom hole assembly 34 to the surface 12. Tube-wire is available commercially from manufacturers such as Draka Cableteq of North Dighton, Mass. Tube-wire 50 is contained within the central bore 32 of the coiled tubing running string 30. FIG. 3 is a cross-section of an exemplary Telecoil® coiled tubing string 30 which includes a tube-wire 50 having a conductive charging wire 52. The conductive charging wire 52 may be a 16-18 gauge stranded copper wire which is surrounded by protective sheath 54. Tube-wire was largely designed to provide power downhole sensors that don't require much power. As a result, the conductive charging wire 52 has a small diameter, on the order of about ⅛ inch. The tube-wire 50 also preferably includes a data cable 56. The data cable 56 is operably interconnected with sensor sub 48 so that data representative of the parameters measured by the sensor sub 48 can be transmitted to the controller 26 located at surface 12. In addition, the data cable 56 can transmit to the controller 26 a signal indicative of the charge level of the batteries 46.

Figure 4:
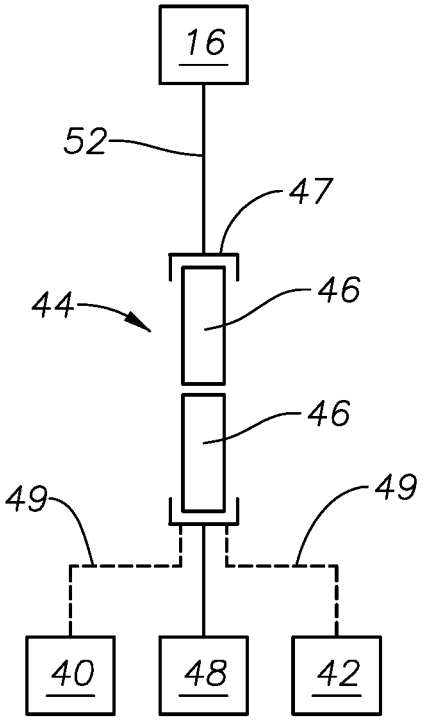
FIG. 4 is a schematic wiring diagram illustrating the interconnection of various electrical components of the coiled tubing-based milling arrangement.

FIG. 4 illustrates electrical interconnection between a number of electrical components used in the coiled tubing-based milling arrangement 28. Tube-wire 50 extends from the electrical power source 16 to the power section 44 so that the rechargeable batteries 46 are provided with power to charge and recharge the batteries 46 when they become depleted. Power section 44 is also operably associated with the sensor sub 48. In some embodiments, as illustrated by broken lines 49, the power section 44 is operably interconnected with the milling motor 40 and/or the vibratory tool 42 so as to supply operating power to these components.

Figure 5:
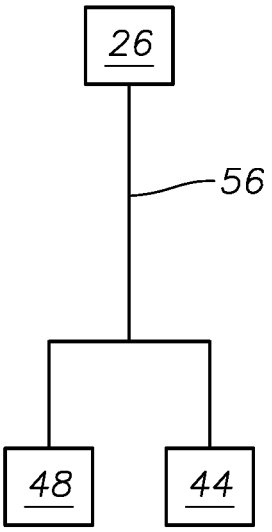
FIG. 5 is a schematic diagram illustrating data cable transmission of signals within the coiled tubing-based milling arrangement.

FIG. 5 schematically illustrates the transmission of signals along data cable 56 within the milling arrangement 28. The data cable 56 extends from the controller 26 and is associated with sensor sub 48. The sensor sub 48 will transmit a signal indicative of sensed operating parameters to the controller 26. Also, the power section 44 can transmit a signal indicative of the charge level of batteries 46 to the controller 26. The data cable 56 may also be used to transmit a control signal from the controller 26 to the sensor sub 48 to turn the sensors of the sensor sub 48 on and off selectively in order to save battery power.

In an exemplary milling operation to remove plug 15 from the wellbore 10, the milling arrangement 28 is disposed into the wellbore 10 until the bottom hole assembly 34 is located proximate the plug 15. The milling motor 40 is then actuated to rotate the mill bit 36. During preferred operation, the vibratory tool 42 will provide reciprocal axial forces to the milling motor 40 and bit 36 to provide impact jarring loads during milling, which will increase the effectiveness and rate of penetration for the mill bit 36. The inventors have determined that actuation of the vibratory tool 42 in this manner would also help prevent helical buckling of the coiled tubing running string 30 by preventing the bit 36 from being locked up with portions of the plug 15 which would result in twisting torque applied to the coiled tubing string 30. It is noted that the batteries 46 of the power section 44 should be charged prior to running into the wellbore 10. During the time the milling arrangement 28 is in the wellbore 10, the batteries 46 are being constantly trickle charged by the power source 16 at surface 12. It is envisioned that the power section 44 can provide operating power to the sensor sub 48 for approximately 20-30 hours before recharging is needed. If the milling motor 40 and/or vibratory tool 42 is/are also being powered by the power section 44, then operating time of about 4-5 hours in to be expected before recharging is needed. When recharging is required, the milling motor 40 and vibratory tool 42 are shut off so that the batteries 46 can recharge. Fully recharging the batteries 46 is expected take from about two hours to about eight hours to accomplish. Since the milling arrangement 28 is capable of providing powered milling for limited time periods, it is well suited to operations, such as removal of a plug 15 or other object, wherein a shorter period of milling would be required. It is further noted that after milling out of the plug 15, the milling bottom hole assembly 34 can be moved to a second location within the wellbore 10 to mill away another plug or object within the wellbore 10.

It should be understood that the invention provides a milling assembly for use in a wellbore to mill away one or more objects or obstructions in the wellbore 10. A described milling assembly 28 includes a coiled tubing running string 30 and a milling bottom hole assembly 34.

It should also be understood that the invention provides methods for removing an object from a wellbore. An exemplary method of removing an object includes the steps of disposing the milling assembly 28 into the wellbore 10 until the milling bottom hole assembly 34 is located proximate an object to be removed, such as plug 15. The milling motor 40 is actuated to rotate the mill bit 36 to mill away the object. In accordance with certain embodiments, the vibratory tool 42 is actuated to impart vibratory reciprocal axial forces to the milling motor 40 and bit 36. During milling, the sensor sub 48 provides a signal via the data cable 56 to the controller 26 which is indicative of at least one operational parameter that is sensed by the sensor sub 48. In preferred embodiments, the operational parameters include tension, compression and torque experienced by the coiled tubing running string 30 during milling. Also in accordance with preferred methods, the power section 44 is recharged via conductive charging wire 52 from surface-based power source 16. Preferably also, a signal indicative of the charge level of the rechargeable batteries 46 is transmitted to the controller 26 via the data cable 56 from the cradle 47.

Those of skill in the art will recognize that numerous modifications and changes may be made to the exemplary designs and embodiments described herein and that the invention is limited only by the claims that follow and any equivalents thereof.

What is claimed is:

1. A milling assembly for use in milling away an object in a wellbore, the milling assembly comprising:

a coiled tubing running string defining a flowbore along its length;

a milling bottom hole assembly affixed to a distal end of the coiled tubing running string, the milling bottom hole assembly including a milling motor and a mill bit that is rotated by the milling motor to mill away the object;

a sensor sub incorporated in the milling bottom hole assembly, the sensor sub being operable to detect at least one operational parameter associated with the wellbore and/or a drilling operation;

a power section incorporated within the milling bottom hole assembly and having a rechargeable power source to provide electrical operating power to the sensor sub, the rechargeable power source being retained within a cradle which is supplied with power to charge the rechargeable power source during operation;

a conductive charging wire located within the flowbore of the coiled tubing running string, the conductive charging wire providing electrical power from a surface-based power supply to the rechargeable power source.

2. The milling assembly of claim 1 wherein the milling bottom hole assembly further comprises a vibratory tool which imparts vibratory forces to the milling motor and mill bit.

3. The milling assembly of claim 2 wherein the power section provides electrical operating power to the vibratory tool.

4. The milling assembly of claim 1 wherein the conductive charging wire comprises tube-wire.

5. The milling assembly of claim 1 wherein the sensor sub detects at least one of the following: tension, compression and torque experienced by the coiled tubing running string.

6. The milling assembly of claim 1 wherein the milling motor is hydraulically actuated by fluid flow through the coiled tubing running string.

7. The milling assembly of claim 1 further comprising a data cable located within the flowbore of the coiled tubing running string, the data cable transmitting a signal indicative of the at least one operational parameter to a controller at surface.

8. The milling assembly of claim 7 wherein the data cable further transmits a signal indicative of a charge level of the rechargeable power source to the controller.

9. A milling assembly for use in milling away an object in a wellbore, the milling assembly comprising:

a coiled tubing running string defining a flowbore along its length;

a milling bottom hole assembly affixed to a distal end of the coiled tubing running string, the milling bottom hole assembly including a milling motor and a mill bit that is rotated by the milling motor to mill away the object;

a sensor sub incorporated in the milling bottom hole assembly, the sensor sub being operable to detect at least one operational parameter associated with the wellbore and/or a drilling operation;

a power section incorporated within the milling bottom hole assembly and having a rechargeable power source to provide electrical operating power to the sensor sub;

a conductive charging wire located within the flowbore of the coiled tubing running string, the conductive charging wire providing electrical power from a surface-based power supply to the rechargeable power source;

the rechargeable power source being retained within a cradle which is supplied with power to charge the rechargeable power source during operation; and a vibratory tool within the milling bottom hole assembly which imparts vibratory axial forces to the milling motor and mill bit during milling.

10. The milling assembly of claim 9 wherein the sensor sub detects at least one of the following: tension, compression and torque experienced by the coiled tubing running string.

11. The milling assembly of claim 9 wherein the conductive charging wire comprises tube-wire.

12. The milling assembly of claim 9 wherein the power section provides electrical operating power to the vibratory tool.

13. The milling assembly of claim 9 further comprising a data cable located within the flowbore of the coiled tubing running string, the data cable transmitting a signal indicative of the at least one operational parameter to a controller at surface.

14. The milling assembly of claim 13 wherein the data cable further transmits a signal indicative of a charge level of the rechargeable power source to the controller.

15. A method of milling away an object in a wellbore, the method comprising the steps of:

disposing a milling assembly into the wellbore, the milling assembly having a coiled tubing running string and a milling bottom hole assembly, until the milling bottom hole assembly is located proximate the object;

actuating a milling motor in the milling bottom hole assembly to rotate a mill bit to mill away the object;

sensing at least one operational parameter of the group including tension, compression and torque experienced by the coiled tubing running string during milling, the sensing of at least one operational parameter being performed by a sensor sub which is powered by a rechargeable power source;

recharging the rechargeable power source during the time that the sensor sub is sensing the at least one operational parameter; and transmitting a signal indicative of the sensed operational parameter to a surface-based controller.

16. The method of claim 15 further comprising the step of:

transmitting to the controller a signal representative of a charge level of the rechargeable power source.

17. The method of claim 15 wherein the step of recharging the rechargeable power source is performed by surface-based power source.

18. The method of claim 17 wherein recharging power from the surface-based power source is provided to the rechargeable power source by a conductive charging wire within the coiled tubing running string.

19. The method of claim 15 further comprising the step of imparting vibratory axial forces to the milling motor and mill bit during milling with a vibratory tool within the milling bottom hole assembly.

* * * * *